United States Patent [19]

Schreder

[11] Patent Number: 4,888,470

[45] Date of Patent: Dec. 19, 1989

[54] SEALED ELECTRIC HOTPLATE

[75] Inventor: Felix Schreder, Oberderdingen, Fed. Rep. of Germany

[73] Assignee: E.G.O. Elektro-Gerate Blanc u. Fischer, Fed. Rep. of Germany

[21] Appl. No.: 234,263

[22] Filed: Aug. 19, 1988

Related U.S. Application Data

[63] Continuation-in-part of Ser. No. 900,781, Aug. 27, 1986, Pat. No. 4,766,290.

[51] Int. Cl.[4] ..... H05B 3/70

[52] U.S. Cl. ..... 219/458; 219/457

[58] Field of Search ..... 219/443, 448, 449, 451, 219/457, 458, 459, 460, 461, 464, 467, 463

[56] References Cited

U.S. PATENT DOCUMENTS

| | | | |
|---|---|---|---|
| 1,093,754 | 4/1914 | Ball | 219/458 |
| 2,101,110 | 12/1937 | Thornton, Jr. | 219/445 |
| 2,664,492 | 12/1953 | Fischer | 219/457 |
| 2,727,133 | 12/1955 | Scofield | 219/463 |
| 3,016,444 | 1/1962 | Jasionowski | 219/451 |
| 3,300,621 | 1/1967 | Fischer | 219/457 |
| 3,327,095 | 6/1967 | Hanson | 219/451 |
| 3,561,020 | 2/1971 | Fritzsche | 4/634 |
| 3,612,829 | 10/1971 | Evans et al. | 219/460 |
| 3,838,249 | 9/1974 | Detterbeck | 219/460 |
| 4,122,330 | 10/1978 | Fischer et a. | 219/449 |
| 4,348,581 | 9/1982 | Fischer | 219/461 |
| 4,394,565 | 7/1983 | Dills | 219/433 |
| 4,490,603 | 12/1984 | Fischer et al. | 219/463 |
| 4,491,722 | 1/1985 | Fischer et al. | 219/458 |
| 4,506,141 | 3/1985 | Scott | 219/451 |
| 4,554,438 | 1/1985 | Schreder | 219/463 |
| 4,658,118 | 4/1987 | Kicherer et al. | 219/451 |

FOREIGN PATENT DOCUMENTS

| | | | |
|---|---|---|---|
| 516910 | 9/1955 | Canada | 219/461 |
| 1021967 | 1/1958 | Fed. Rep. of Germany | 219/457 |
| 1130574 | 5/1962 | Fed. Rep. of Germany | 219/457 |
| 1192806 | 5/1965 | Fed. Rep. of Germany | 219/457 |
| 2909776 | 9/1980 | Fed. Rep. of Germany | 219/467 |
| 531091 | 6/1968 | France | 219/463 |
| 161470 | 11/1957 | Sweden | 219/443 |
| 1341753 | 12/1973 | United Kingdom . | |

OTHER PUBLICATIONS

Chromalox Electric Range Units, Bulletin RU-149, Edwin L. Wiegand Co., 7500 Thomas Blvd., Pittsburgh 8, PA, 9-22-50. (219/443).

*Primary Examiner*—Teresa J. Walberg
*Attorney, Agent, or Firm*—Steele, Gould & Fried

[57] ABSTRACT

A sealed electric hotplate can be simply fitted by lateral insertion into a hob. For this purpose a hotplate with a cast metal body is surrounded by a very wide trim ring, which is provided with centering projections. The wide ring is separately grounded, in that a grounding line is provided between the trim ring or the hotplate body or the plug-in connection. Electrical connections are made through a two part insulating hosing received in a bottom cover plate which fixes the housing parts together and allows uninsulated leads to the heating resistors.

14 Claims, 9 Drawing Sheets

FIG. 8
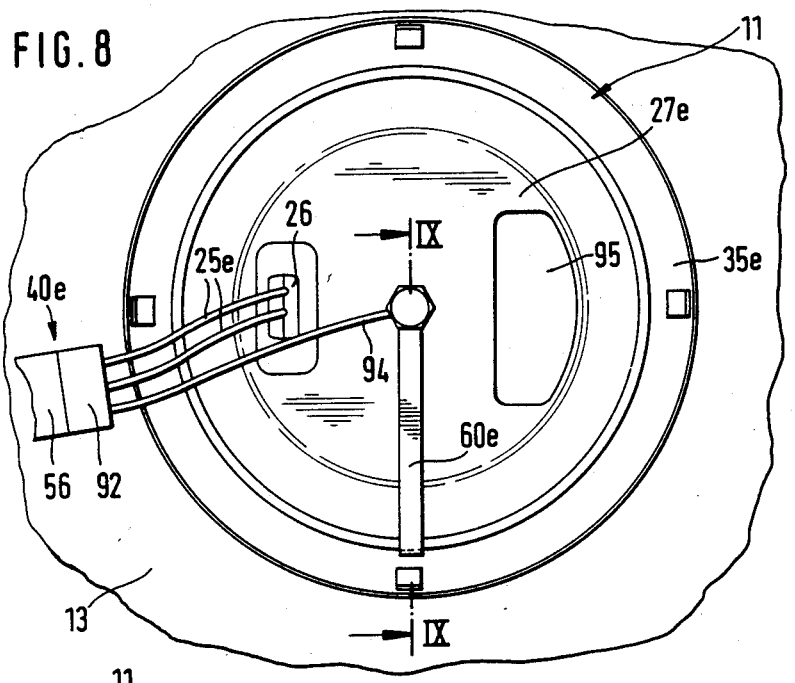
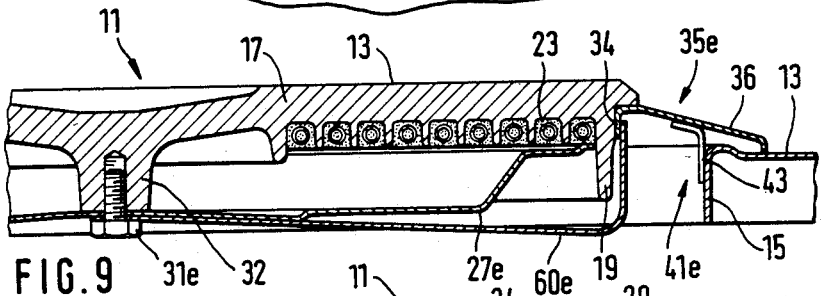
FIG. 9
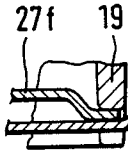
FIG. 10
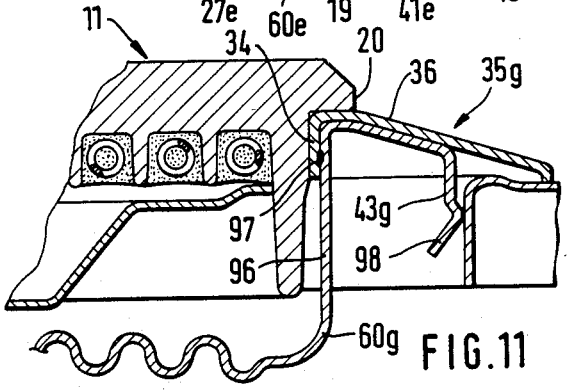
FIG. 11

SEALED ELECTRIC HOTPLATE

CROSS REFERENCE TO RELATED APPLICATION

This is a continuation-in-part of application Ser. No. 900,781 on August 27, 1986, now U.S. Pat. No. 4,766,290.

BACKGROUND OF THE INVENTION

1. Field of the Invention

The invention relates to electric hotplates with a hotplate body having a sealed cooking surface, which is generally made from cast iron and is provided on its underside with heating resistors in the form of wire coils received in ribs in an embedding material (compare U.S. Pat. No. 3,300,621.

2. Description of the Prior Art

The cast iron hotplate body of hotplates of this type is normally surrounded by a pressed-on sheet steel trim ring, which has an inverted U or V-shape. They are fitted into the mounting opening of a mounting plate and the hotplate is braced downwards by a clamp (U.S. Pat Nos. 1,093,754; 2,664,492; British Pat. No. 1,341,753 and, DE-OS 29,09,776). The connection to a power supply is normally by means of screwed-down flexible lines (U.S. Pat. No. 4,348,581). However, hotplates with plug-in connections are also known, which are inserted from above in connector sockets (German Pat. No. 1,021,967).

The underside of this hotplate is covered by a cover plate through which the connection leads are guided by bushings. A second cover plate is provided in a middle area of the first cover plate. Therein the plug connections are mounted in an insulating piece. This arrangement results in a very high cooking hob, which cannot be built-in easily in working surfaces of kitchens.

From U.S. Pat. No. 4,122,330, an electrical hotplate is known which comprises a temperature limiter which is mounted below a cover plate of the hotplate and is also used for housing the hotplate connections.

U.S. Pat. No. 4,658,118, filed on July 10, 1985 and issued on Apr. 14, 1987, shows a quadrangular shaped bushing inserted into a cover plate of a hotplate.

Wide trim rings are known for use in connection with glass cooking hobs, in order to protect the glass plate from the hotplate temperature and for this purpose shielding rings are also provided (U.S. Pat. No. 4,490,603).

Clamps acting in the edge region are frequently used for securing the hotplates (DE-AS 1,130,574; U.S. Pat. No. 3,561,020). In the case of glass mounting plates, the mounting openings are much larger than the diameter of the hotplate body, an accordingly use has been made of centering means and in part by shimmed seals (U.S. Pat. Nos. 3,838,249; 4,491,722 and U.S. Patent application Ser. No. 245,541, filed for on Sept. 3, 1981, in conjunction with Ser. No. 968,048, filed on Dec. 12, 1978 in the name of Karl Fischer and entitled "ELECTRIC COOKER PLATE").

However, it is also conventional practice to use hotplates which do not have a sealed cooking surface and generally comprise spirally wound tubular heaters. These are arranged in optionally interchangeable trays with edges which rest on a mounting opening of a hob. They are connected by means of plugs fitted to the ends of the tubular heaters and these are laterally inserted into connector sockets.

SUMMARY OF THE INVENTION

An object of the invention is to provide a sealed hotplate, which can easily be interchanged with such open hotplates, so as to make it possible to have a hotplate which is more reliable and safe, as well as easier to clean and into which no overflowing cooking material can penetrate. A further object of the invention is to ensure the electrical safety of the hotplate, even under unfavorable conditions.

OBJECT OF THE INVENTION

The invention provides a hotplate with a double cover on its underside, including the usual cover plate which covers the heated underside of the hotplate body and which rests preferably on a downwardly extending flange surrounding the hotplate body. This cover plate is covered again by a tray- or bowl-like cover which has, except for its fixing screw, no direct contact to the hotplate body, but only to a trim ring surrounding the hotplate body. Therefore, this bowl is not subjected to direct contact heating from the hotplate and is considerably less hot so that the resulting hotplate unit may be inserted into hobs which are situated in kitchen counters, appliances or the like. The second tray or bowl holds also the unit hotplate body/trim ring and itself together in a unitary body. A horizontally arranged plug connector can be easily provided at this tray or bowl and the rather stiff electrical connection leads may be guided through the cover plate and the tray directly into the housing of the plug connector member where they can be easily fixed thereto.

BRIEF DESCRIPTION OF THE DRAWINGS

FIG. 8 is a view of the hotplate from below .

FIG. 9 is a partial section along line-IX in FIG. 8.

FIGS. 10 and 11 show details of slightly modified embodiments.

DETAILED DESCRIPTION OF THE PREFERRED EMBODIMENTS

Figure 1:
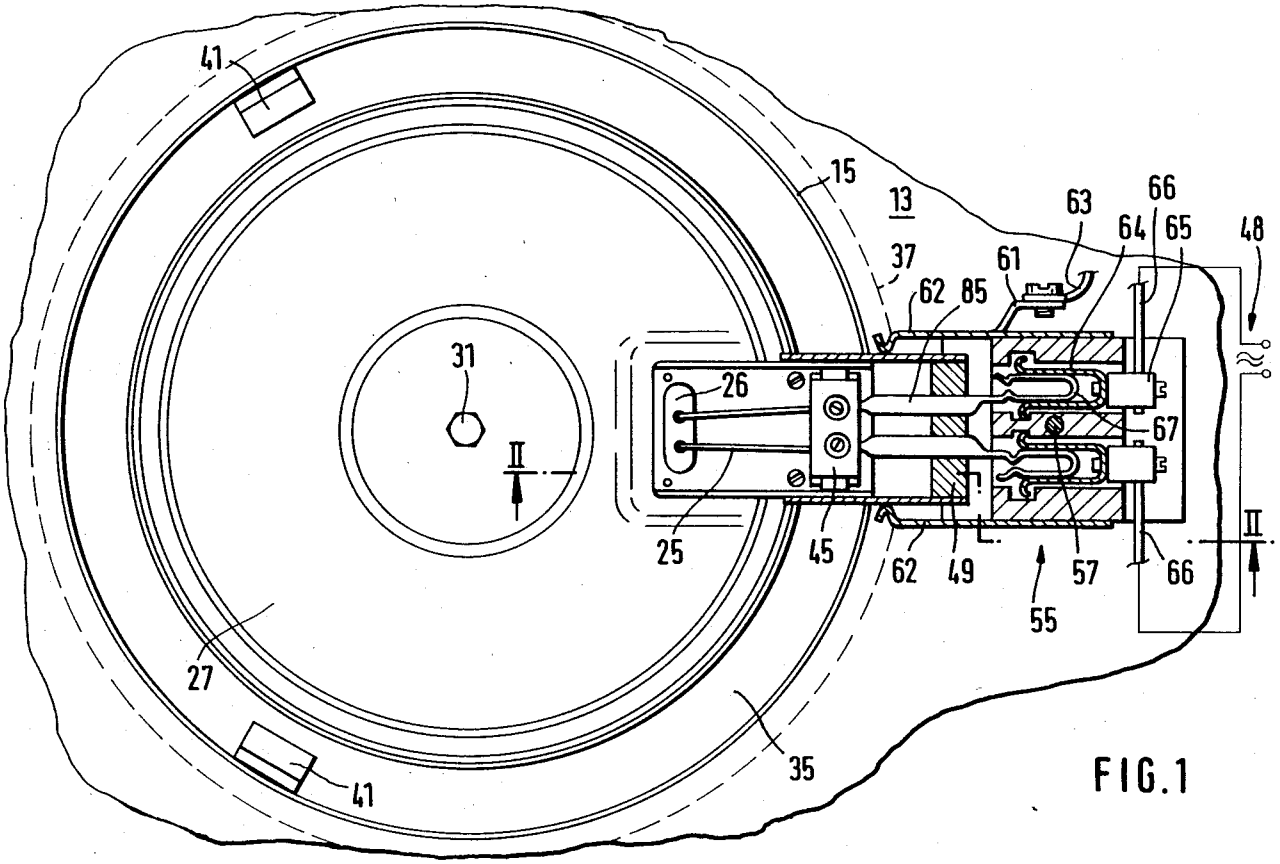
FIG. 1 is sectional view of a hotplate according to the invention, from below.
Figure 2:
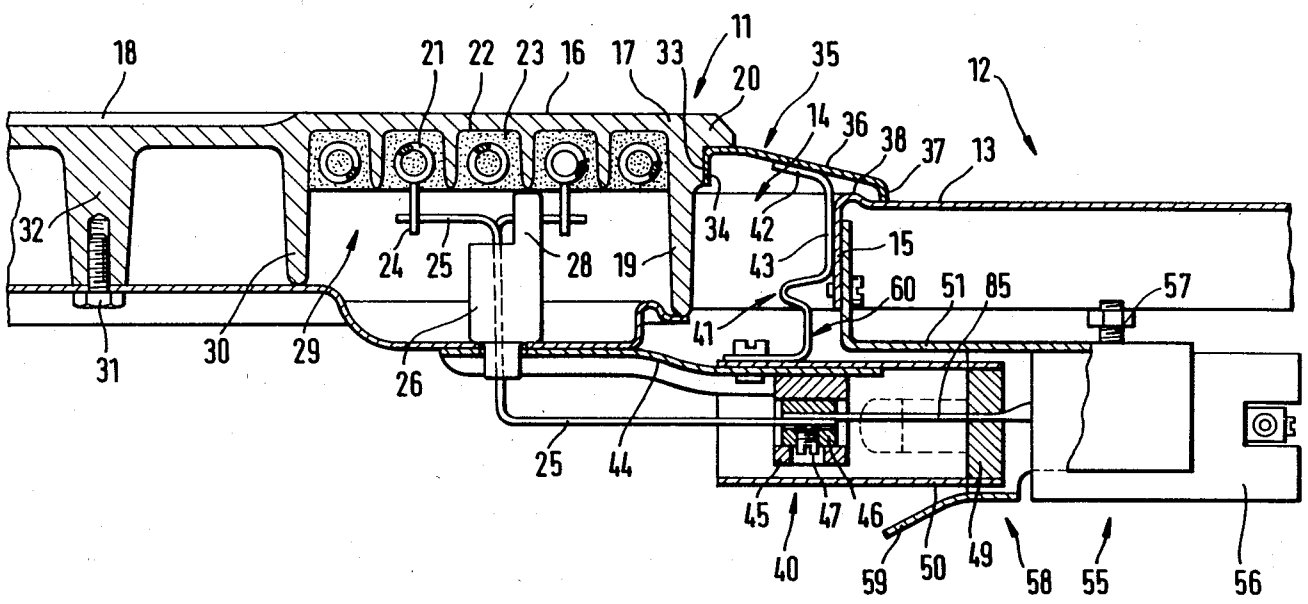
FIG. 2 is a partial section along line-II.

FIGS. 1 and 2 show an electric hotplate 11, fitted in a cooking hob 12, of which the upper mounting plate 13 is shown in the form of a sheet metal plate whose surface is normally enamelled. Hob 12 has a mounting opening 14, which is surrounded by a downwardly directed edge or rim 15 of mounting plate 13.

An electric hotplate 11 with a sealed planar cooking surface 16 is fitted into mounting opening 14. Hotplate body 17 is made from cast iron and is in the form of a relatively thin-walled plate, whose upper-facing cooking surface 16 surrounds a somewhat recessed central zone 18 in ring-like manner. The hotplate body is provided on its outer circumference with an upper edge flange 20 and a flange-like, downwardly projecting, substantially cylindrical outer edge 19 connecting onto the same. The annular cooking surface 16 is heated from below by electric heating resistors 21, which comprise wire coils, which are located in spiral slots 22 in an electrically insulating, pressed-in, embedding material 23. The terminals 24 for the resistors forms pins projecting out of the embedding material 23 and are welded to solid lead wires 25, which pass through a bushing 26 made from heatproof insulating material which is guided by a cover plate 27 closing the underside of the hotplate and which is pressed by projections 28 against the underside of the hotplate.

Cover plate 27 rests on a downwardly projecting inner edge inwardly bounding the heated zone 29 and is fixed by a screw 31, which is screwed in a central cast metal projection 32 projecting downwards in the unheated central zone 18 of the hotplate.

Below the edge flange 20 on the outer face of outer edge 19 is provided a cylindrically turned reception section 33, to which is fixed by pressing on a substantially cylindrical inner section 34 of a mounting or trim ring 35, made from enamelled or stainless sheet sheet. Its very wide central section 36, inclined outwards at a very small angle of preferably between 5° and 10°, e.g. 7°, is supported on the underside of edge flange 20 and terminates on the outside in a more steeply downwardly directed outer edge 37, which rests on the surface of mounting plate 13 close to the mounting opening and surrounds the latter. An upwardly directed bead 38 of the mounting plate surrounds mounting opening 14 and prevents liquid from running into the latter.

The edge or rim, which can have a total width of 1.5 to 3 cm (3/5 to 1 1/5 inch), preferably approximately 2 cm (4/5 inch), covers a relatively large spacing between the hotplate body 17 or its outer rim 19 and the opening ring 15 of the mounting plate. This spacing is only slightly less than the width of the trim ring 35. It is therefore possible to introduce the hotplate from above into the mounting opening 14 in such a way that its connection 40 can be moved laterally below the mounting plate and this spacing also acts in an insulating manner and prevents significant heating of mounting plate 13.

The hotplate is centered in the mounting opening 14 by special centering means 41. In the embodiment, the centering means comprise three clips uniformly distributed around the mounting ring circumference and fixed to its lower face by spot welding, said clips having a fixing portion 42 and a downwardly directed centering portion 43, which cooperates with the inner face of the opening edge 15. The centering means can be constructed so resiliently that they bring about a certain clamping action on the inner face of the opening edge.

Connection 40 has a fixing plate 44 fixed to the cover plate 27 by spot welding or screwing and through which the bushing 26 partly projects and which projects substantially horizontally over the hotplate on one side. Close to its outer end, it carries an insulating material connecting piece 45, which contains screw fixing sleeves 46 for the lead wires 25, which pass out of the bushing and run parallel to the fixing plate 44. Within the screw fixing sleeves, the lead wires are conductively locked by screws 47 to conductors 85 comprising sheet metal strips and which pass through an insulating material guide part 49 at the free end of a connecting housing 50.

The connecting housing 50 is a sleeve having a rectangular cross-section, formed by bending a sheet metal strip, said sleeve surrounding the connecting piece 45 and the connecting housing 50. The sleeve projects with a substantially horizontal axis radially outwards and downwards over the end of fixing plate 44. Fixing plate 44, projecting into connecting housing 50, is screwed thereto, while interposing a grounding means 60, which comprises a sheet metal strip bent in S-shaped manner to improve the spring action. The strip is connected to one of the centering portions 43. Therefore the trim ring 35 is safely electrically conductively connected to the connecting housing 50, contacted on both sides by grounding clips 62 of a connecting member 55, screwed to a fixing clip 51 on the opening ring 15, and mechanically and electrically connected in this way to the mounting plate. Member 55 contains an insulating material connecting socket 56, connected by means of a guide screw 57 so as to have a limited movement in the vertical direction with a socket housing 58, which has the fixing clip 51, grounding clip 62 and a lower insertion bevel 59. The socket plate has a grounding connection 61 to which is screwed a grounding line 63.

Connecting socket 56 contains U-shaped or tulip-shaped bushes 64 made from a resilient material and which are connected to screw connection bushes 65, to which are connected the two connecting leads 66 of the hotplates, which lead by means of a control device (not shown) to a domestic power supply 48.

The strip-like leads 85 are turned by 90° at their ends projecting out of guide piece 49 and are shaped to form a resilient plug-in connecting pin 67, by being bent in U-shaped manner and provided with two inwardly directed, facing corrugations, which can be supported against one another and therefore maintain resilient tension even in the case of higher contact pressures. The connecting pins 67 together with the bushes 64 form a good contacting plug connection. Connection housing 50 together with the guide piece 49 ensure that the pins are sufficiently rigid to permit insertion into the bushes and namely via a substantially horizontal movement of the entire hotplate, while tilting slightly downwards. The length of connection 40 and the position of connecting member 55 are such that the hotplate is correctly centered in the mounting opening 14 when the plug connection 64, 67 is in its coupling position.

The remaining drawings show modifications of the embodiment described relative to FIGS. 1 and 2 and which could be advantageous for certain applications. Hereinafter only the differences compared with the embodiment of FIGS. 1 and 2 will be described and the same parts will be given the same reference numerals. Parts with a comparable construction and function are followed by a reference letter. The previous description also applies here. Therefore the features of the first embodiment can also be advantageously used with the other embodiments.

Figure 3:
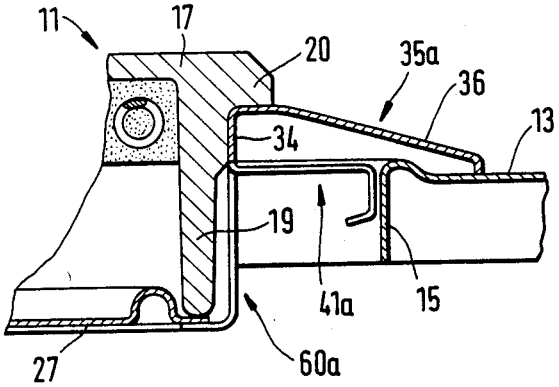
FIGS. 3 to 5 are vertical partial sections through hotplate units of further preferred embodiments.

FIG. 3 shows a construction of a trim ring **35*a* which, while having otherwise an identical construction to the trim ring 35 shown in FIG. 2, is shaped with its centering means 41*a* in one piece on the inner portion 34. The centering means form clips bent outwards in L-shaped manner at a number of locations on the circumference for cooperating with the opening edge 15. On the inner portion 34 is also shaped an L-shaped, downwardly directed grounding clip 60***a*, which is conductively connected to the cover plate 27 by spot welding or screwing.

Figure 4:
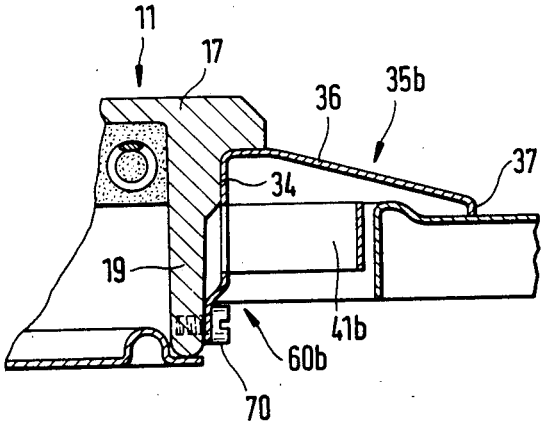
Figure 5:
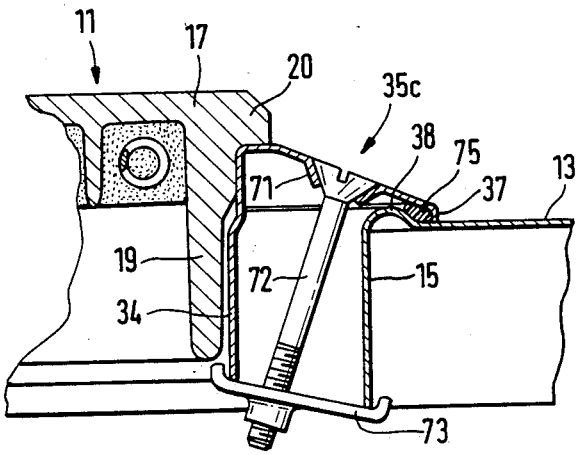

FIG. 4 shows a construction of a trim ring 35*b* largely corresponding to FIG. 3, in which once again centering and grounding means are connected in one piece to the ring. However, in this construction the centering means 41*b* is shaped from a sheet metal strip of the trim ring material, bent in bow-shaped manner from the circumferential direction and therefore runs in a different plane as compared with FIG. 3 here again a grounding clip 60*b* is provided, which is conductively connected by means of a screws 70 to the rim 19 of hotplate body 17. According to FIGS. 1 and 2, its grounding is ensured by means of the central screw 31, support plate 44 and connecting housing 50.

Whereas the hotplate according to FIGS. 1 and 2 is held in the mounting opening 14 by its own weight and the plug connection, it may be desirable to fix the hotplate to mounting 13, for example so that the cooker can be securely transported. At two or more points on its circumference, trim ring 35*c* has downwardly formed depressions 71 for a flat-head screw 72, which is screwed in sloping manner from above into a clamp 73. The clamp is supported on the lower edge of the substantially cylindrical inner portion 34, extended over and beyond outer rim 19 and the lower edge of the opening rim 15, so that by insertion and tightening of screws 72, the hotplate can be firmly secured from above against mounting plate 13, even if it is not accessible from below. However, if this is to be the case, it is possible to use clamp bolts fixed to the underside of the trim ring and they can then be tightened from the bottom. A seal 75 in the form of a heat-resistant sealing ring or gasket is placed between bead 38 and the outer edge 37 of trim ring 35*c* and is secured there. It prevents the penetration of moisture, even if there should be large liquid quantities present on the mounting plate.

Figure 6:
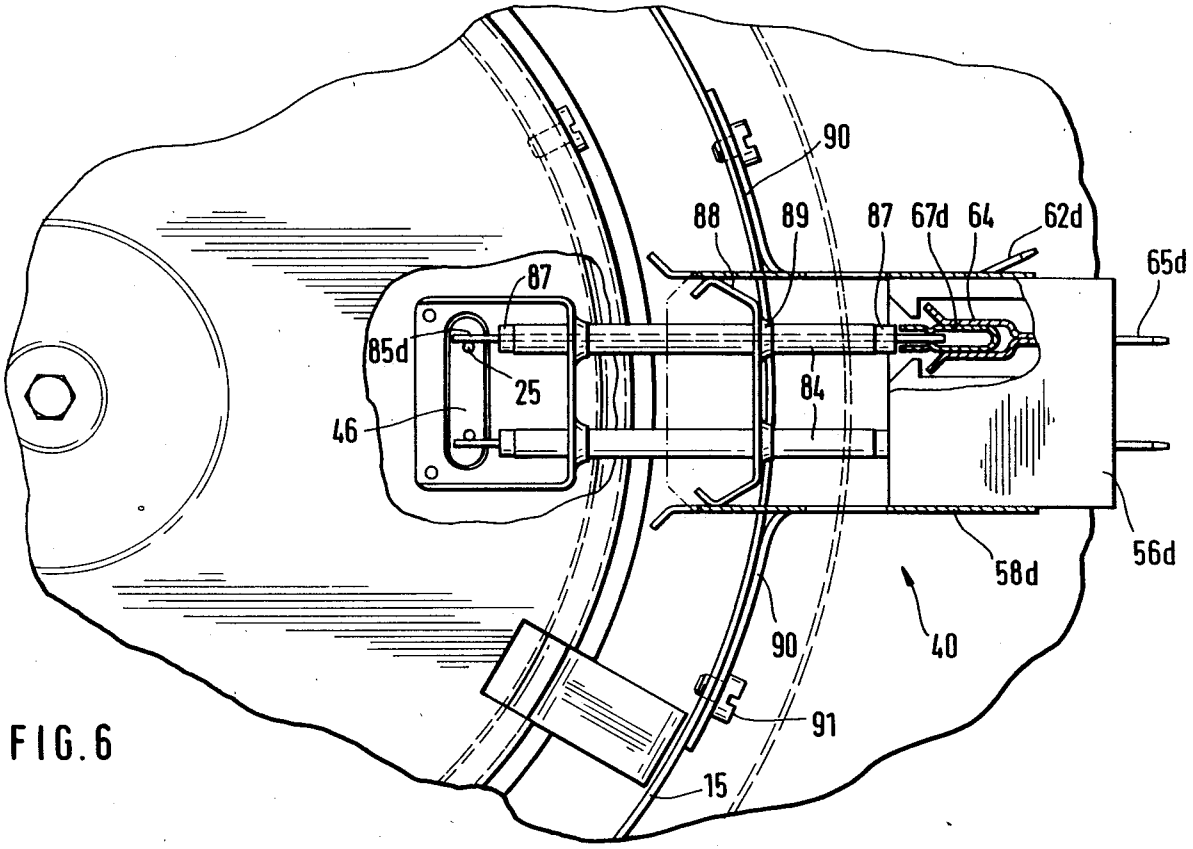
FIG. 6 is a partial section along line-VI in FIG. 7.
Figure 7:
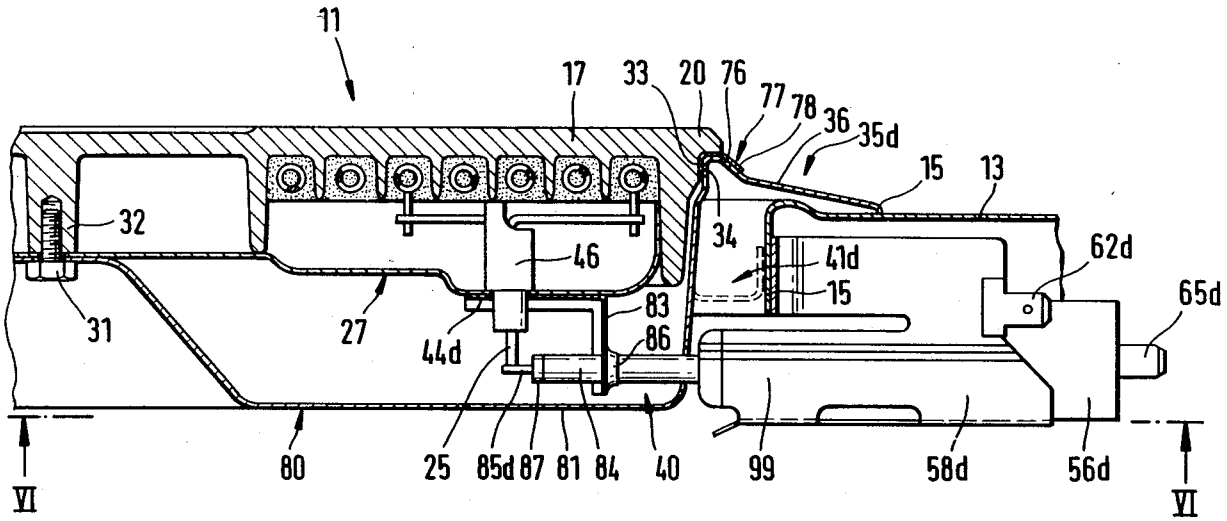
FIG. 7 is a vertical partial section through part of the hotplate and the mounting plate.

FIGS. 6 and 7 show a hotplate 11, which differs as regards its connection 40 and the trim ring with centering and grounding from the embodiment of FIGS. 1 and 2. Trim ring 35 is provided, following onto its central portion 36, with an upwardly pointing bead 76, which is placed in the lower recess of a circumferential ring 77 made from thin, stainless steel sheeting. This circumferential ring is pressed onto the reception surface 33 of hotplate body 17, is supported on the underside of flange 20 and has a very narrow, downwardly sloping outer portion 78. Its total width is only 5 to 10 mm (preferably 8 mm) and only projects 3 to 7 mm (preferably 5 mm) over the edge flange 20. Such a circumferential edge or rim is standard for other hotplate mounting types. Due to its cooperation with the trim plate 35, it is also possible to use a hotplate for the described advantageous mounting form.

To trim ring 35*d* is connected a reception tray 80 made from the sheet material, whose outer edge in an extension of inner portion 35 runs substantially cylindrically and whose bottom downwardly covers the connecting parts. In the vicinity of a central bulge, the reception tray is electrically conductively screwed by screw 31 to the projection 32 of hotplate body 17. A sheet metal flap is stamped and bent out from the outer rim of tray 80, runs in L-shaped manner outwards and upwards and forms a centering means 41*d*. Thus, on part of the trim ring 35*d*, reception tray 80 forms the centering means 41*d* and also the means grounding the trim ring, adequately covering the live parts of the hotplate.

Bushing 46 projects through an L-shaped fixing plate 44*d*, whose edges are stiffened by bends and through whose downwardly projecting L-legs 83 project guide tubes 84 and are welded there in the vicinity of sleeves 86, drawn out of the material of guide plate 44*d*. The guide tubes 84 are stainless steel tubes with front and rear insulating plugs 87, which are filled with an insulating embedding material. Solid connecting leads 85*d* project longitudinally through them and are welded to the leads 25. At a distance from the free end thereof, a grounding clip 88 is placed on the two parallel guide tubes 84 and is also welded in the vicinity of sleeves 89. The clip has lateral resilient arms engaging on the inner face of a socket sheet metal housing 58*d* and form a conductive grounding connection. The ground clip also provides a mechanical connection between the guide tubes and reinforces the connection, so as to permit the problem-free insertion of the plug-in connecting pins welded to the free end of leads 85*d*. Pins 67*d* are U-shaped sheet metal parts with an upper constriction welded to the outside of the connecting lead 85*d*. They can be inserted in bushes 64*d*, which are arranged in the connecting socket 56*d* and run out into plug-in connecting lugs 65*d*, which project from socket 56*d* and on which can be mounted the connecting lines. A grounding connecting lug 62*d* is provided on the side.

The socket sheet metal housing 58*d* is substantially U-shaped and substantially receives the connecting socket 56*d*. The lateral faces 99 cooperating with the arms of the grounding clip 88 have lateral and lower insertion bevels. The upper portion of the lateral faces runs out in laterally sloping, bent away connecting clips 90, which are screwed by screws 91 to the inside of opening rim 15. The guide tubes provide a mechanical reinforcement and electrical insulation of the connecting leads, which can therefore serve as a plug-in connection.

FIGS. 8 and 9 show electric hotplate 11 provided on its underside with a cover plate 27*e*, whose edge region rests on embedding material 23 and not, as in FIG. 2, on the outer edge or rim 19. Trim ring 35*e* has the same basic shape as in FIG. 2 and is provided on its underside with centering means 41*e*, which comprise L-shaped clips welded onto the underside of trim ring 35*e* and whose vertically downwardly directed legs form the centering portion 43. One end of an L-shaped grounding clip 60*e* is welded to the cylindrical inner portion 34 and the outer rim 19 thereof runs vertically downwards and then substantially parallel to cover plate 27*e* up to the central cast metal projection 32, where it is screwed by screw 31*e* in conductive manner to hotplate body 17, together with the cover plate 27*e*.

Connection 40*e* is constructed in the form of flexible connecting leads 25*e*, which project through bushing 26 and are combined at the end thereof in a plug 92. The latter can be plugged into a connecting socket 56 fixed to the underside of mounting plate 13, a connection also being provided for a flexible grounding line 94, electrically conductively connected to the hotplate body by screw 31*e*. In this construction, the hotplate can be connected in such a way that firstly the plug-in connection is inserted, which can be made twist-proof by a corresponding design of the connecting pins (not shown) and the reception thereof and then the hotplate is placed in the mounting opening.

During transportation, a depression 95 in the cover plate 27*e* can receive the connecting socket 92, so that space-saving stacking is possible.

FIG. 10 shows that the grounding clip 60e in FIG. 9 can be passed through a recess in outer rim 19, so that grounding clip 60f does not downwardly increase the hotplate dimensions or cause any other disturbance. Cover plate 27f is also located in the vicinity of the lower rim edge and can be provided with an inward stamping at this point.

FIG. 11 shows a construction corresponding to FIG. 9, in which the grounding clip 60g is made from a corrugated sheet metal strip and is therefore longitudinally extensible. It can therefore more easily be adapted to the circumstances and there also no danger of accidental ripping out. At the end of its vertically upwardly projecting portion 96 it is connected to the inner portion 34 of trim ring 35g by a spot weld 97 and then continues on below the central portion 36 of trim ring 35g until, through a downward bend, a resilient centering portion 43g with a downwardly inwardly directed insertion bevel 98 is formed.

Figure 12:
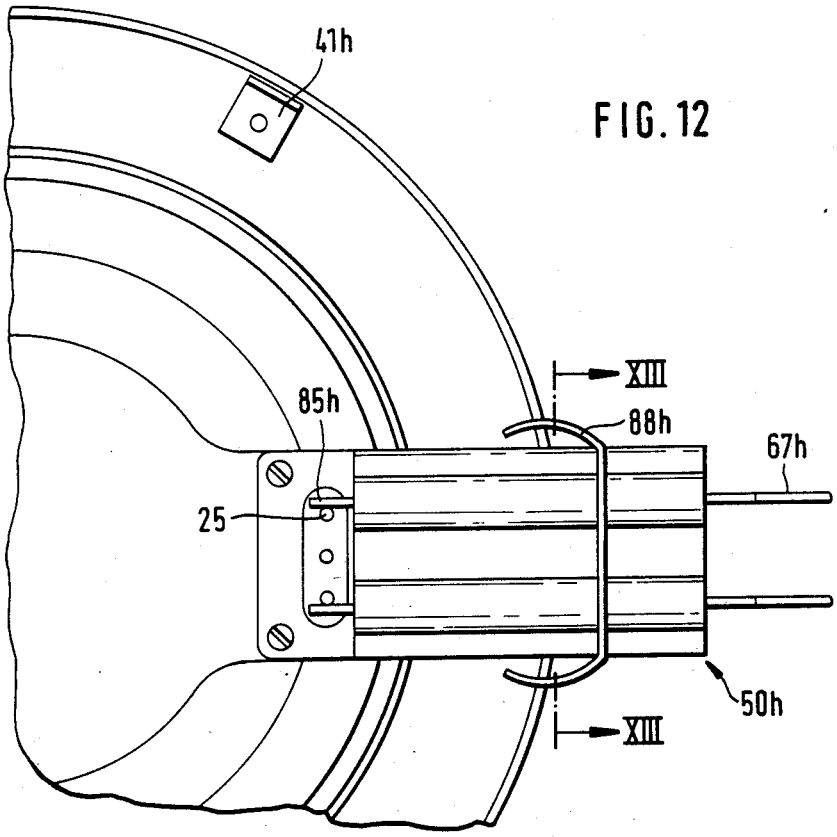
FIG. 12 is a partial view of the hotplate from below.
Figure 13:
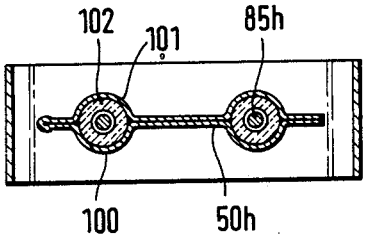
FIG. 13 is a section along line-XIII in FIG. 12.
Figure 14:
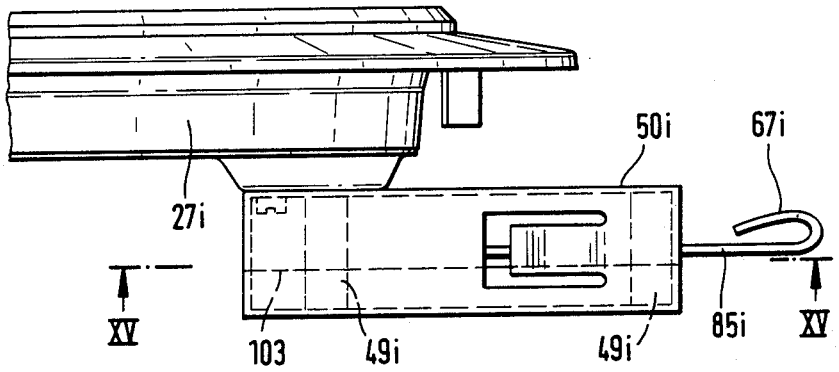
FIGS. 14 and 15, are a side view and part section along line-XV.
Figure 15:
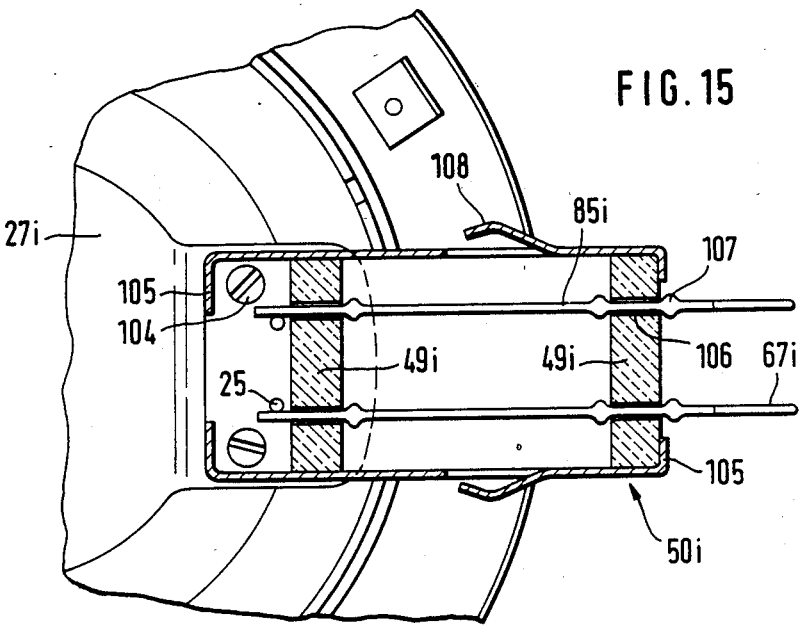

FIGS. 12 and 13 show a construction in which the connecting housing 50h is formed from two sheet metal half-shells 100, 101, which are optionally bent together from a sheet metal part and between them form two tubular, longitudinally directed channels, in which are located e.g. steatite insulating tubes 102, in which are guided leads 85h. Leads 85h are welded to the hotplate leads 25. A grounding clip 88, corresponding to that shown in FIG. 6, is engaged and welded onto the connecting housing 50h. Like the remainder of the connection, it serves to cooperate with a connecting member corresponding to that shown in FIGS. 6 and 7. The plug-in connecting pins 67h are formed as U-shaped or tear-shaped bends of the leads 85h and are shown in side view in FIG. 14. Centering means 41h correspond to those according to FIG. 9, but the L-leg fitted to the trim ring underside points outwards FIGS. 14 and 15 show a construction, in which the connecting housing 50i also fulfills the function of the fixing plate. It comprises a rectangular box, bent together from a sheet metal portion and interconnected at a longitudinal edge 103 by beading, and said box is screwed by means of screws 104 to the end cover 27i. The narrow sides are partly closed by inwardly bent clips 105. In the interior of connecting housing 50i are provided two guide pieces 49i with maximum reciprocal spacing and through which project the two connecting leads 85i and which are longitudinally fixed by flat pressings 107 of the flat wire carried out upstream and downstream of the bushing openings 106. The connecting leads 85i are made from solid, good conducting wire and are welded to the hotplate connecting leads 25 and bent round by somewhat more than 180° at their outer ends for forming plug-in connecting pins 67i, as can be seen in FIG. 14. Resilient clips 108 are bent out from the lateral faces of connecting housing 50i and form contact prongs for grounding purposes in conjunction with a connecting member, much as shown in FIG. 6

It is clear that as a result of the represented and described features, particularly if the combination of the wide trim ring is used together with the centering and grounding means, as well as a horizontal plug-in connection, the possibility is provided of using hotplates with a sealed surface in cookers, which were previously not intended for these.

Figure 16:
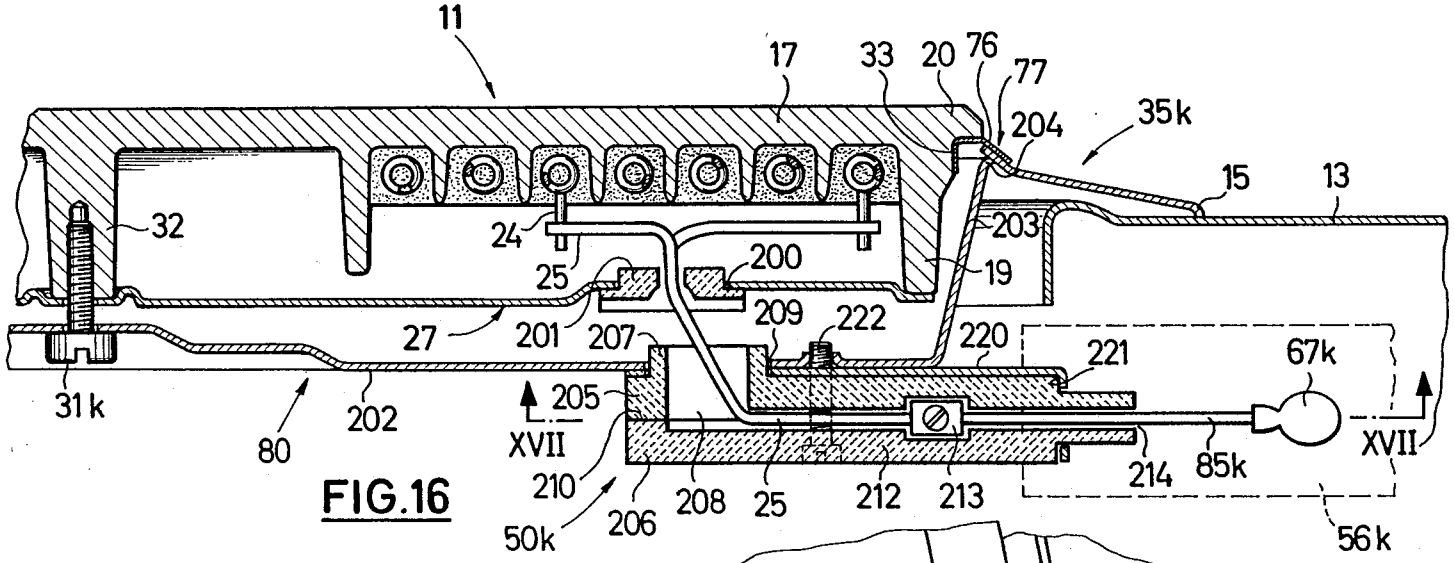
FIG. 16 is a partial section through a preferred embodiment.
Figure 17:
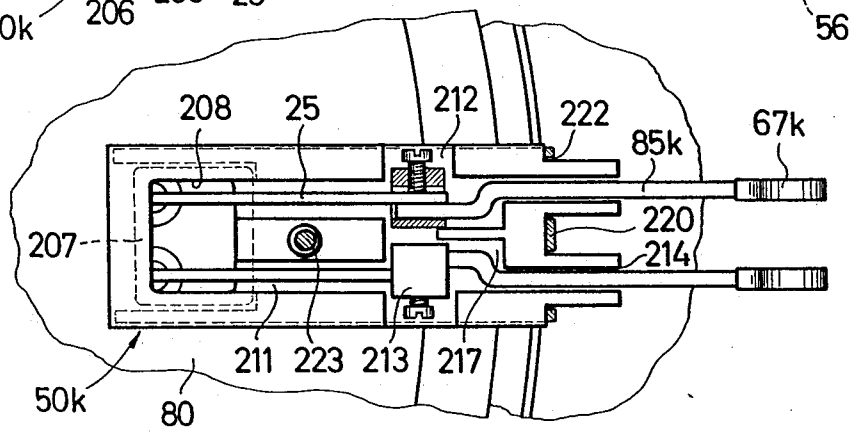
FIG. 17 a view from below along the line-XVII in FIG. 16.

FIG. 16 shows a hotplate of the kind and with the features described before, e.g. with respect to FIGS. 1 and 2, 6 and 7. It is, therefore, not once more described in detail, only the different features. On the lower edge of rim 19 of hotplate body 17 a cover plate 27 rests which is fixed to middle projection 32 of hotplate body 17 by a connection as described in detail in the applicant's patent application Ser. No. 170,275, filed on Mar. 18, 1988 with the title "Electric Hotplate, Apparatus and Method for Fitting a Cover Plate Thereto".

The cover plate comprises an opening 200 in which the bushing 201 made of electrically insulating ceramic material such as from steatite is inserted and fixed thereto. It has a generally plate-shaped form and comprises at least two openings penetrating the bushing from one side to another and guiding the connection lines 25 through the cover plate opening. The bushing is of the kind as described in applicant's patent application for "Electric Hotplate", Ser. No. 79,576, filed July 29, 1987.

The connection leads 25 are rather stiff metal wires, which is necessary because they have to withstand rather high temperatures and because they lead directly to connecting pins 24 of the heating resistors.

The underside of cover plate 27 and also of the hotplate body, including the rim or flange 19, is covered by a tray or bowl 80 which has a bottom part 202 and upwardly directed rim 203, the upper edge 204 of which rests on the lower surfaces of an intermediate ring 35 of an outer trim ring 35k and presses it upwardly to the lower face of an inner trim ring 77.

The inner trim ring or circumferential ring 77, pressed to a reception surface 33 of the hotplate body 17, is like the usual trim ring for such kinds of hotplate and is relatively narrow and has a downward sloping outer surface 76. It rests on the underside of an outer flange 20 of the hotplate body 17.

The outer trim ring 35k is rather broad and has a rather flat slope to the outside. It rests with its outer edge 15 on the mounting plate 13.

The tray 80 is fixed to the hotplate body and pressed upwardly by a middle screw 31k screwed into a thread in the middle projection 32. It is thereby pressed upwardly and its upper edge 204 engages the outer ring 35k at a place where the outer ring underlies the trim ring 77 so that tray 80 and both trim rings are pressed tightly together and against the hotplate body, thereby forming a closed solid unit.

In the bottom part 202 of tray 80 a connecting housing 50k is mounted. The connecting housing 50 comprises an upper part 205 and a lower part 206 which are relatively flat or plate-like parts of electrical insulating ceramic materials, such as steatite, which are put together along a horizontal plane 210, whereby the lower part 206 provides a lid for the upper part. The upper part 205 has a rim 207 around a quadrangular opening 209 in the tray and is guided therein as to be secured against turning movement.

In the plane 210, which divides parts 205 and 206 from each other, there are provided ducts 211, which are indented partly in the upper part 205 and partly in the lower part 206. A deeper indented recess 212 protrudes through the housing 50k from one side to another and houses two screw connections sleeves 213 in the opening of which the connection leads 25 and leads 85k can be connected by the screws which are accessible from lateral sides. They can, however, also be made accessible from the lower face of housing 50k or may be replaced by plug connections.

A duct 213 leads from recess 212 to openings 214 in the outer face of housing 50k, which is elongated and mounted in a radial direction with regard to the hotplate body. Therefore, the plugs or pins 67k point generally horizontally and radially or laterally, outside over the outer rim of the hotplate body in order to be inserted into a connection socket 56k similar to that shown in FIG. 6.

The leads 85k of pins 67k are bent to a Z-shape in the area of a recess 217 of duct 213 adjacent to the connection sleeve 213. Thereby the pins or plugs 67k are prevented from being turned and it is possible to provide for different positions and/or spacings of the pins relative to each other, in order fit to different types of sockets. In this case ducts 213 should be placed differently, but the general spacing of connection leads 25 from each other as well as the over all width of the housing may be retained. A sheet metal part 220 is inserted between tray 80 and the upper housing part 205. It has a generally L-shape covering, the upper side and the outside face 221 of housing 50k. It has two openings 222 into which two meshing protrusions each of the upper and the lower housing parts are inserted, which protrusions surround the openings 214 for the connection pins 67k. Thereby, the housing parts are clamped to each other and safely spaced. Furthermore, the sheet metal part provides a grounding connection which is contacted by grounding means of the socket 56k.

The sheet metal part has projections which pass on both lateral sides of rim 207 and secure the sheet metal part in alignment to the housing. Parts 205, 206 and sheet metal part 220 are fixed to tray 80 by screw 223, which is screwed into the tray 80.

It can be recognized that by this embodiment the connection leads can be directly and safely guided through the cover plate and tray without being themselves insulated and without any intermediate connection or any danger of coming into contact with cover plate or tray. Bushing 201 and opening 208 are somewhat spaced in a radial direction from each other so that they fit to the bend of the connection leads. Both parts of housing 50k can be manufactured in a rather simple manner with an only two piece mold. Opening 209 and rim 207 can fit together such that the upper part 205 of housing 50k can fix into the opening also without screw 223, thereby simplifying the mounting. The whole inside of the connection piece 50k is easily accessible from below, i.e. from above while mounting because mounting takes place when the hotplate is situated upside down. After all connections are made, the lid 206 is inserted into openings 222 and fixed by only one screw.

In this same preferred embodiment also the feature shown in FIG. 7 is very advantageous in some cases of application, i.e. using a tray which is integral with the outer ring 35k. This increases the good mechanical contact between all parts of the unit. It is necessary, however, to manufacture the tray of the same material as the outside rim which is usually made of stainless steel.

What is claimed is:

1. A sealed electric hotplate for fitting in a mounting opening of a mounting plate, comprising:

a hotplate body with a planar, sealed cooking surface, electric heating resistors which are embedded in electrically insulating manner on an underside of the hotplate body and can be connected to a power supply by connecting lead means;

electric connecting means for connecting the heating resistors to a connecting member located below a mounting plate;

sheet metal trim ring means surrounding the hotplate body;

cover plate means fixed to the hotplate body covering the underside of the hotplate body and having an opening;

tray means fixed to the hotplate covering an underside of the cover plate means having an opening and having an upper rim which is pressed against the trim ring means from below;

electrically insulating bushing means for guiding the connecting lead means through the opening in the cover plate means; and, electrically insulating means mounted at the opening of the tray means for guiding the connecting lead means therethrough.

2. Hotplate according to claim 1, wherein the trim ring means comprise an inner trim ring engaging the hotplate body and an outer trim ring resting with its outer edge on the mounting plate, the upper rim of the tray means engaging the outer trim ring from below and pressing the outer trim ring against the inner trim ring.

3. Hotplate according to claim 1, wherein the tray means is integral with an outer trim ring resting on the mounting plate, and formed as an outer rim of the tray means, the upper rim of the tray means being pressed against a lower surface of the trim ring means engaging the hotplate body.

4. Hotplate according to claim 1, wherein the housing comprises a rim surrounding the housing opening, which rim extends through the tray means opening.

5. Hotplate according to claim 4, wherein the rim and the tray means opening have a generally quadrangular shape.

6. A sealed electric hotplate for fitting in a mounting opening of a mounting plate, comprising:

a hotplate body with a planar, sealed cooking surface, electric heating resistors which are embedded in electrically insulating manner on an underside of the hotplate body, the resistors to be connected to a power supply by connecting leads means;

electric connecting means for connecting the heating resistors to a connecting member located below mounting plate;

sheet metal trim ring means surrounding the hotplate body;

cover plate means fixed to the hotplate body covering the underside of the hotplate body, and having an opening;

tray means fixed to the hotplate, completely covering an underside of the cover plate means, the tray means having an opening;

electrical insulating means for guiding the connecting lead means through the opening in the cover plate means;

the electrical connecting means having an electrically insulating housing, mounted at and covering the opening of the tray means, an opening of the housing being aligned with the tray means opening for guiding the connecting lead means into said housing in an electrically insulated manner; and, the electrical connecting means comprising plug connection means connected to the connecting lead means and extending from said housing laterally over an outer circumference of the hotplate body.

7. Hotplate according to claim 6, wherein the connecting lead means are uninsulated wires.

8. Hotplate according to claim 7, wherein the sheet metal member provides grounding means for the hotplate, the sheet metal member being contacted by a grounding connection of the connecting member.

9. Hotplate according to claim 6, wherein the housing comprises an upper housing part and a lower housing part which define between them guide ducts for the connecting lead means which guide duct means are connected to the housing opening.

10. Hotplate according to claim 9, wherein the connecting lead means are uninsulated wires and the two parts of the housing are inserted in an opening of the sheet metal member for clamping the two parts together, the sheet metal member providing grounding means for the hotplate by contact with a grounding connection of the connecting member.

11. Hotplate according to claim 9, wherein the connecting lead means are uninsulated wires and both housing parts and the sheet metal member are penetrated by a fixing screw screwed into the tray means and securing the electric connecting means to the tray means, the sheet metal member providing grounding means for the hotplate by contact with a grounding connection of the connecting member.

12. Hotplate according to claim 6, wherein a sheet metal member is fixed between the housing and the tray means.

13. Hotplate according to claim 6, wherein the housing comprises connectors for connecting the connecting lead means to the plug connection means.

14. Hotplate according to claim 6, wherein the plug connection means comprise an elongated metal structure having a generally Z-shaped bend, which is located in a recess of the housing for preventing turning movement of the plug connection means.

* * * * *